US008052548B1

(12) United States Patent
Stanisic et al.

(10) Patent No.: US 8,052,548 B1
(45) Date of Patent: Nov. 8, 2011

(54) TENNIS TEACHING DEVICE

(76) Inventors: David Stanisic, Sonoma, CA (US); Lisa L. Dorman, Sonoma, CA (US)

( * ) Notice: Subject to any disclaimer, the term of this patent is extended or adjusted under 35 U.S.C. 154(b) by 0 days.

(21) Appl. No.: 12/790,347

(22) Filed: May 28, 2010

(51) Int. Cl.
*A63B 69/38* (2006.01)

(52) U.S. Cl. ..... 473/464

(58) Field of Classification Search ..... 473/422, 473/459, 461, 463, 464, 553
See application file for complete search history.

(56) References Cited

U.S. PATENT DOCUMENTS

| | | | | |
|---|---|---|---|---|
| 3,858,881 | A * | 1/1975 | Hurwitz | 473/553 |
| 4,150,821 | A * | 4/1979 | Racz | 473/464 |
| 4,209,169 | A * | 6/1980 | Roberts | 473/464 |
| 5,005,833 | A * | 4/1991 | Groveman et al. | 473/464 |
| 5,476,257 | A * | 12/1995 | Bobby | 473/464 |
| 5,618,040 | A * | 4/1997 | Parten | 473/461 |
| 6,827,654 | B2 * | 12/2004 | Meyer | 473/212 |
| 6,945,884 | B1 * | 9/2005 | Korik | 473/464 |
| 7,147,581 | B1 * | 12/2006 | Williams, III | 473/464 |
| 7,354,361 | B2 * | 4/2008 | Williams, III | 473/464 |
| 7,381,140 | B1 * | 6/2008 | Stanisic | 473/464 |
| 7,445,570 | B2 * | 11/2008 | Rodgers et al. | 473/464 |
| 7,559,859 | B2 * | 7/2009 | Rodgers et al. | 473/464 |
| 2006/0287139 | A1 * | 12/2006 | Williams, III | 473/464 |
| 2007/0087868 | A1 * | 4/2007 | Williams, III | 473/464 |
| 2007/0123372 | A1 * | 5/2007 | Bilsey et al. | 473/464 |
| 2007/0275796 | A1 * | 11/2007 | Carter | 473/459 |
| 2008/0220911 | A1 * | 9/2008 | Rodgers et al. | 473/461 |
| 2009/0069128 | A1 * | 3/2009 | Bilsey et al. | 473/461 |
| 2010/0069179 | A1 * | 3/2010 | Rodgers et al. | 473/464 |

FOREIGN PATENT DOCUMENTS

DE 4016588 A1 * 11/1991

* cited by examiner

*Primary Examiner* — Raleigh W. Chiu
(74) *Attorney, Agent, or Firm* — Bay Area Technology Law Group PC

(57) ABSTRACT

Training device to improve tennis skills. The training device includes an umbilical having a first end and a second end. The first end is attached to a wristband for encircling the wrist of a user and the second end is attached to a tennis racquet. The umbilical is under constant tension during use to encourage the movement of a user's hands in unison in carrying out the tennis stroke.

5 Claims, 2 Drawing Sheets

TENNIS TEACHING DEVICE

TECHNICAL FIELD

The present invention involves a training device to improve tennis skills. The device encourages a player to bring his or her hands together to encourage the player's hands to move his or her hands in unison in carrying out a tennis stroke.

BACKGROUND OF THE INVENTION

In providing instruction to tennis players for improving a player's skills, it is emphasized that not only should the hand holding the racquet move to a position prepatory for stroking the ball but that the user's other hand move in the same direction thus causing a user's body to turn appropriately. This properly aligns the shoulders and increasing the effectiveness of the stroke, improving ball velocity and placement while minimizing injury. Conversely, many players, particularly novice players, move only the hand holding the racquet allowing the other hand to remain idly by and giving little or no consideration to body positioning in preparing for the return of an oncoming tennis ball. In doing so, ball velocity, accuracy, consistency and pace are reduced and, perhaps more importantly, ball direction on the return stroke can be haphazard and unpredictable.

The present invention is not the first teaching of an aid to improve tennis skills by coordinating wrist movement of a user. Specifically, U.S. Pat. No. 5,005,833 teaches a device for joining a player's wrists together so as to engender movement of both arms and shoulders together in executing a tennis stroke. This patent further suggests extending, from a wristband and onto a user's middle finger a loop to prevent or reduce palmar flexion.

Although the invention described and claimed in the '833 patent is of interest in recognizing the benefits of joining a player's wrists together in executing a tennis stroke, it has been found that the components suggested for implementing this function are inadequate and do not, in the final analysis, provide the intended function. Specifically, the '833 patent suggests employing straps for joining first and second wristbands together. The buckled straps of the prior art can be changed in length through the use of buckles but once fixed, the straps represent nothing more than rigid extenders providing no tension between a user's wrists when the straps have not been pulled to their full extended length and, of equal importance, do not enable the wrists of a user to extend beyond the fixed strap length.

The straps suggested in carrying out the invention disclosed in the '833 patent are deficient for a number of reasons Firstly, unless the straps are pulled to their full fixed length, neither wrist of the user is encouraged to move in the direction of the other. As such, when the dominant or racquet hand of a user moves, there is nothing to encourage the subservient hand to move in the same direction unless in moving the dominant hand, full strap length is established between wrists causing the subservient hand to be yanked or abruptly pulled in the direction of the racqueted hand. This is hardly a way to encourage unison wrist movement. Secondly, there are times in which the distance between the wrists of a user are to be greater than the intended spacing between wrists during tennis strokes. For example, if the training device is to be employed for all purposes both during training and in participating in an actual match, ball service, requiring an overhead stroke would undoubtedly require wrist spacing far greater than if a forehand or backhand was to be conducted using this training aid under normal circumstances. The fixed strap of the '833 patent would prevent overhead or service strokes if the strap was to be fixed at a normal spacing for forehand and backhand play.

The present application is highly related to U.S. Pat. No. 7,381,140 belonging to Applicant. In that application, a training device was taught comprising wristbands for encircling each wrist of a user, a tension device and an umbilical attached thereto and to the wristbands, the umbilical being under constant tension during use of the training device to encourage movement of a users hand in unison in carrying out a tennis stroke Although this device has great practicality, in employing two wristbands which are unrelated to the tennis racquet it was found that misplacing the wristbands was of a common occurrence and that the invention could be made more practical if the umbilical under constant tension was attached to the subservient hand at its wrist employing a wristband similar to that taught in '140 patent but that instead attaching the umbilical to the dominant wrist of a user, it is instead attached to the racquet itself. Ideally, the device could be embedded within the racquet during manufacture resulting in a practical training tool readily available to a user without having to attach separate stand alone devices to a users wrist in order to accomplish the goals presented herein.

It is thus an object of the present invention to provide a teaching aid for improving tennis skills which is devoid of the limitations of the prior art.

It is yet a further object of the present invention to provide a tennis aid tensioning and thus encouraging unison of movement between the wrists of a player to improve tennis skills These and further objects will be more readily apparent when considering the following disclosure and appended claims.

SUMMARY OF THE INVENTION

A training device to improve tennis skills, said training device comprises an umbilical having a first end and a second end, said first end being attached to a wristband for encircling the wrist of a user and the second end being attached to a tennis racquet, said umbilical being under constant tension during use of said training device to encourage the movement of the user's hands in unison in carrying out a tennis stroke

DETAILED DESCRIPTION OF THE INVENTION

Figure 1:
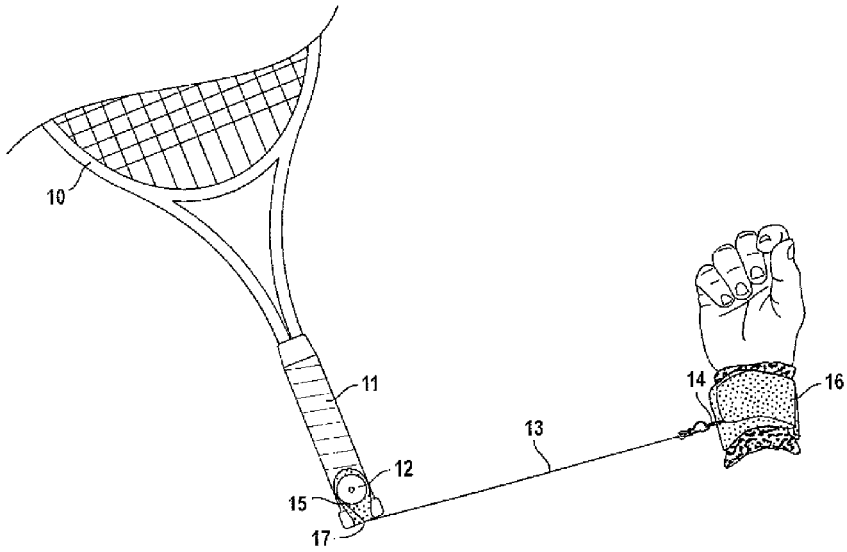
FIGS. 1 and 2 are plan views of two racquets embodying alternative embodiments of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Figure 2:
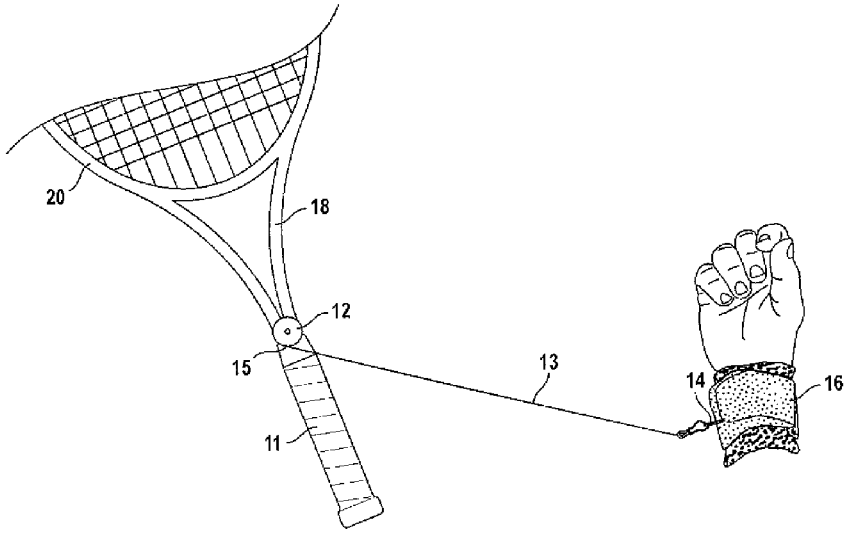

In turning to FIGS. 1 and 2 which are alternative configurations of a portion of the present invention, the present training device comprises umbilical 13 having first end 14 and second end 15, the first end being attached to wristband 16 for encircling a wrist of a user and second end 15 being attached to tennis racquet 10 (FIG. 1) or 20 (FIG. 2). Umbilical 13 is under constant tension during use of the training device by employing a suitable tension spool such as badge reel 12 to encourage movement of the users hands in unison in carrying out the tennis stroke The details of wristbands 16 are disclosed in Applicant's previously issued U.S. Pat. No. 7,381,140, the disclosure of which is incorporated by reference. It was noted that wristbands 16 are normally used by a player in order to act as a sweat absorbent member in order to prevent moisture from compromising a user's grip. However, wristband 16 can be made of unitary members while remaining within the spirit and scope of the present invention.

Figure 3:
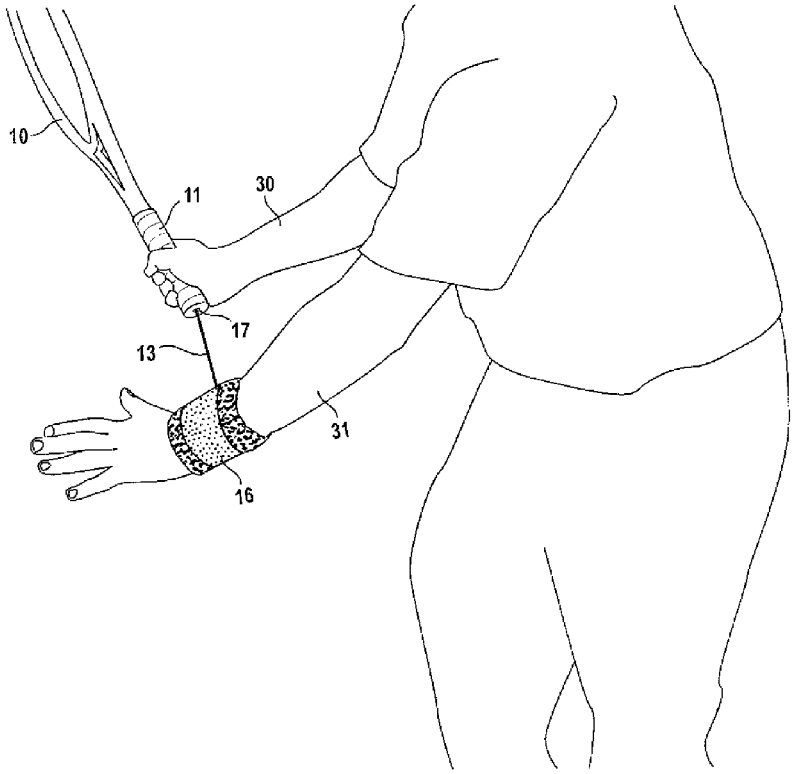
FIG. 3 is a perspective of a user's hands and wrists together with a suitable racquet embodying the present invention ready for play.

Appended to first end 15 of umbilical 13 is constant tension device 12 ideally in the form of badge reel. Such devices are in common use and generally contain a tension spring appended to an umbilical such that the entire length of the umbilical, is maintained under tension as long as there is minimal payout from the umbilical's rest position as shown in FIG. 3. The umbilical, contained completely within tension device 12 is terminated at its first end at wristband 16 which can be attached thereto by an umbilical clip (not shown) depicted in Applicant's previously issued '140 patent.

In placing tension device 12 within handle 11 of racquet 10, payout of umbilical 13 can be made at butt end 17 of handle 11. In such an embodiment, tension device or badge reel 12 would be built within handle 11 at the time of manufacture of racquet 10. This is the preferred embodiment of the present invention for tension device 12 would be completely enclosed within handle 11 making for a very neat and clean payout of umbilical 13

Alternatively, racquet 20 can support tension device or badge reel 12 at throat 18. Spring loaded spool or badge reel device 12 can be built into throat 18 at the time of manufacture of racquet 20 or it can be situated therein through the use of Velcro or other common attachment protocols in order to convert a racquet 20 into the training device of the present invention. The badge reel could also be secured to the racquet handle as an after market add-on, such as by use of a hook and loop band.

In operation, a user having dominant right hand 30 would grasp racquet 10 as shown in FIG. 3. Umbilical 13 would feed from butt end 17 of handle 11 to be connected under tension to wristband 16 as shown. FIG. 3 shows a user in preparation for a fore hand tennis stroke. As dominant arm 30 is connected to subservient arm 31 through racquet 11, as the dominant hand moves back with the racquet, the nondominant hand shadows the racquet's movement following the same path thus encouraging the shoulder and upper torso of the player to rotate. This critical action is highly encouraged in creating the appropriate dynamics for a successful stroke and in returning the ball. This training device also encourages a minimal limited and restricted takeback which aids in the readiness of the player to strike the ball because the player's hands are maintained and their confined sensation of being in front of the player as well as being close together.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like.

Therefore, the above description and illustration should not be considered as limiting the scope of the invention, which is defined by the appended claims.

What is claimed is:

1. A training device to improve tennis skills, said training device comprises an umbilical, a wristband and a tennis racquet wherein said umbilical has a first end and a second end, said first end being attached to said wristband for encircling the wrist of a user and the second end being attached to said tennis racquet, said umbilical being under constant tension during use of said training device to encourage the movement of the user's hands in unison in carrying out a tennis stroke.

2. The device of claim 1 wherein said training device comprises a badge reel for causing spring loaded tension of said umbilical.

3. The device of claim 2 wherein said badge reel is positioned at the throat or handle of said tennis racquet.

4. The device of claim 3 wherein said badge reel is encased by said handle and said umbilical is paidout from the handle from the butt end thereof.

5. The training device of claim 1 wherein said umbilical is of a tensioned length sufficient to enable a user's wrists to spread apart from one another at full span without said umbilical preventing such movement.

* * * * *